US005896629A

United States Patent [19]

Van Hooreweder

[11] Patent Number: 5,896,629

[45] Date of Patent: Apr. 27, 1999

[54] FASTENER

[75] Inventor: Godwin Jeroom Odo Ghislenus Van Hooreweder, Bruges, Belgium

[73] Assignee: Godwin, besloten vennootschap mat beperkte annsprakelijkheid, Bruges, Belgium

[21] Appl. No.: 08/973,474

[22] PCT Filed: Jun. 11, 1996

[86] PCT No.: PCT/BE96/00058

§ 371 Date: Dec. 17, 1997

§ 102(e) Date: Dec. 17, 1997

[87] PCT Pub. No.: WO97/00629

PCT Pub. Date: Jan. 9, 1997

[30] Foreign Application Priority Data

Jun. 20, 1995 [BE] Belgium ..... 9500545

[51] Int. Cl.[6] ..... A44B 16/00

[52] U.S. Cl. ..... 24/580; 24/575

[58] Field of Search ..... 24/580, 587, 579.1, 24/584, 575, 576, 902, 265 WS, 68 SK, 306, 442, 464, 465

[56] References Cited

U.S. PATENT DOCUMENTS

| | | | |
|---|---|---|---|
| 2,928,100 | 3/1960 | Gagnon | 24/575 X |
| 3,484,907 | 12/1969 | Elsenheimer | 24/580 X |
| 3,495,306 | 2/1970 | Eichberg | 24/580 X |
| 3,682,163 | 8/1972 | Plummer | 24/580 X |
| 4,183,121 | 1/1980 | Cousins | 24/580 X |
| 5,088,162 | 2/1992 | Allen | 24/442 |
| 5,208,952 | 5/1993 | Mintel et al. | 24/580 |
| 5,272,772 | 12/1993 | Hahn | 24/580 X |
| 5,313,691 | 5/1994 | Hashimoto | 24/265 CW X |

FOREIGN PATENT DOCUMENTS

| | | |
|---|---|---|
| 1176188 | 4/1959 | France . |

*Primary Examiner*—Anthony Knight
*Assistant Examiner*—Robert J. Sandy
*Attorney, Agent, or Firm*—Bacon & Thomas, PLLC

[57] ABSTRACT

A fastener for connecting two parts is provided. The fastener includes two main elements, namely a first element having a series of teeth and a second element having a series of hooks connected to one another in a moveable manner which cooperate with the teeth. The teeth and the hooks are shaped such that they mesh freely in a consecutive manner via a rolling-down movement of the second element only. The shape of the teeth and hooks is further such that the meshing may only be undone via a rolling-up movement, that is, a rolling movement in the opposite sense.

14 Claims, 2 Drawing Sheets

FASTENER

BACKGROUND OF THE INVENTION

1. Field of the Invention

The present invention concerns a fastener for connecting two or more parts to one another.

2. Description of the Related Art

Such fasteners in general are already known.

A first known type of fastener consists of what is called a zip-fastener, which in general consists of two rows of identical elements. Each row is attached to a part to be connected.

With this zip-fastener, the two rows of elements must be precisely positioned in relation to one another on one end thereof. They also must be caught by an appropriate coupling piece, after which the elements are drawn towards one another by a pusher which connects them one after the other by meshing.

Such a zip-fastener is particularly suitable for connecting two pieces of material, for example textile. It offers the advantage that the connecting force is distributed over a large number of points resulting in a large tensile strength. It is also advantageous in that it may be closed or undone partly or in full, as required.

In spite of these advantages, such a zip-fastener also has several disadvantages.

A first disadvantage of this known zip-fastener is that the beginning and the end of the fastener are determined by the coupling piece and the pusher.

Further, the tensile strength of the zip-fastener may only be used in the plane of the elements. Shear load must be avoided by using flexible connections between the elements.

Another disadvantage of the zip-fastener is that it becomes unserviceable when an element thereof, the coupling piece or the pusher is damaged.

Another known type of fastener consists of what is called an adhesive fastener which is made of two main parts, namely a first part which may consist of female elements and a second part which may consist of male elements which work in conjunction with one another. The connection is hereby made by pressing both parts together, so that the respective elements mesh. The connection is undone by peeling off one of the parts in relation to the other.

Such an adhesive fastener is advantageous in that the positioning of both parts in relation to one another is not very critical, as the parts to be connected may be placed opposite one another at random.

Other advantages of such an adhesive fastener are that the shearing force is distributed over multiple elements, so that relatively large shearing forces are possible, that the manipulation thereof is very easy and that no auxiliary parts are required, as is the case with a zip-fastener.

However, such an adhesive fastener is disadvantageous in that the strength of the connection made by it depends on the number of elements coupled to one another.

Another disadvantage of such an adhesive fastener is that only shearing forces may be opposed in the connection plane.

Another disadvantage is that the connecting force decreases from frequent use and/or when the connecting planes become dirty.

Finally, the opening of such an adhesive fastener is accompanied by a noise which is generally unpleasant.

Fasteners are known from the documents U.S. Pat. No. 5,088,162, FR-A-1,176,188 and U.S. Pat. No. 3,484,907 for connecting two parts to one another, whereby the fasteners consist of two main parts which may mesh thanks to a snap-effect between elements, whereby certain elements are elastically deformed. Such fasteners have several disadvantages. For example, a force must be exerted to mesh the elements together and to disconnect them, respectively. As the meshing parts are deformed during meshing and disconnecting, they are subject to wear and tear, which has a disadvantageous effect on the fastener after a length of time. To obtain the snap effect, the elements must be made of an elastic, deformable material. Also, the range of material of which the fastener may be made is limited.

SUMMARY OF THE INVENTION

The present invention aims towards a fastener which combines the advantages of the known fasteners and which simultaneously offers a solution to the disadvantages of these known fasteners.

To this aim, the invention comprises a fastener for connecting two parts, whereby this fastener comprises two main elements, namely a first element including at least two teeth and a second element including at least two hooks connected to one another in a moveable manner which cooperate with the teeth. The teeth and hooks are shaped such that they mesh freely in a consecutive manner via a rolling-down movement of the second element only, i.e., without a snap-effect or any noticeable snap-effect that must be overcome. The shape of the teeth and hooks is further such that the meshing may only be undone by a rolling-up movement, a rolling movement in the opposite sense.

In this manner, a fastener which mainly has the following advantages is obtained.

- The position of both parts to be connected may be altered in relation to one another.
- The fastener may take large tensile, pressure, and shearing forces.
- Both elements of the fastener may be easily and very cheaply made in an industrial manner by die-casting, extrusion or the like.
- The fastener may be used both for applications whereby it overlaps, such as with an adhesive fastener, as well as or applications whereby it operates sideways, analogously to a zip-fastener.
- The fastener remains usable when a segment thereof is damaged.
- The fastener may be made such that its functioning is practically unaffected by dirtiness.
- Both rigid and flexible parts may be connected to one another by this fastener.

It is clear that the fastener according to the invention may be used both as an alternative for the known zip-fastener and adhesive fastener. Such a fastener may also be used in various other applications for which it is not customary to use a zip-fastener or adhesive fastener, such as belt fastenings, watchstraps, shoe-buckles, laces, fastening mechanism for suitcases which are adjustable in height, carrier bags and handbags, removable labels or wall fixings, locking chains or laths to prevent burglary, adhesive shoe soles for astronauts, coupling mechanisms for skis, universal locks and connections which must be able to resist vary large forces, etc.

DETAILED DESCRIPTION OF THE PREFERRED EMBODIMENTS

Figure 1:
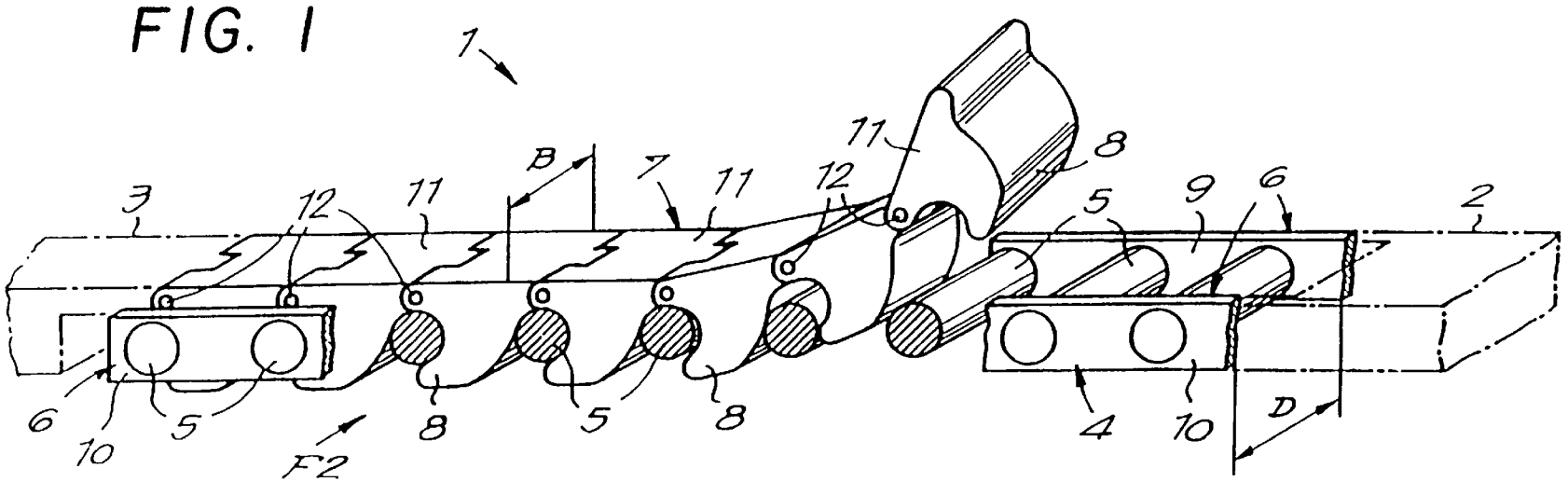
FIG. 1 shows a view in perspective of a fastener according to the invention.

As represented in FIG. 1, a fastener 1, designed to connect two parts 2 and 3 to one another, according to the invention comprises a first element 4 having a series of teeth 5 which are held in a support 6 and a second element 7 having a series of hooks 8 connected to one another in a moveable manner which cooperate with teeth 5.

Teeth 5 and hooks 8 are shaped such that they mesh via a rolling-down movement of second element 7, whereby hooks 8 freely slide between teeth 5 via a rotational movement, that is, by a limited arcuate motion of hooks 8 relative to each other.

In particular, hooks 8 are made such that every two consecutive hooks 8 enclose an intermediate tooth 5 over more than 180° when fastener 1 is closed.

According to the embodiment of FIG. 1, teeth 5 are formed of parallel rods, for example with a circular section, which are fixed between support 6 at their ends. To this end, support 6 comprises two parallel, strip-shaped parts 9 and 10, respectively, extending in a longitudinal direction.

Hooks 8 are part of a series of links 11 which are consecutively connected to one another by a series of pivoting hinges 12.

Figure 2:
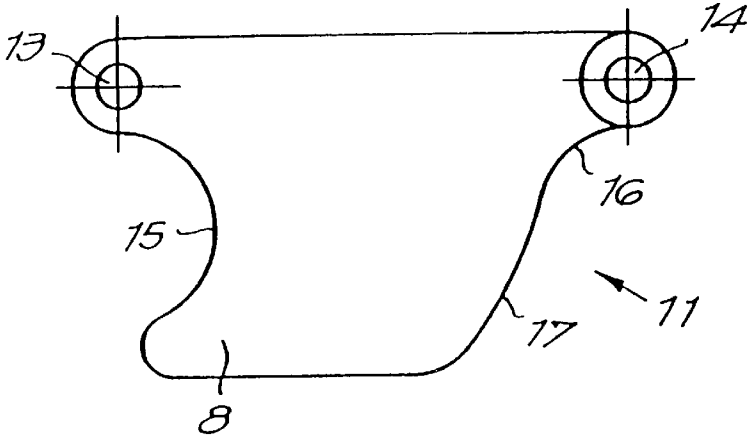
FIG. 2 shows a side view of the part which is represented in FIG. 1 by arrow F2 to a larger scale.

Links 11, the precise shape of which is represented to a large scale in FIG. 2, each show two hinge points 13 and 14, with the exception of a last link in the series at a free end of second element 7, which only has one hinge point 13. Hook 8 belonging to link 11 concerned is situated sideways of, or in this case under, a connecting line between hinge points 13 and 14. Hook 8 hereby has a circular recess 15 on one side which extends over an angle of less than 180°, and a concave, cylinder-shaped part 16 on the other side which runs into a convex part 17 towards a free end of hook 8.

It is clear that the pitch of links 11 is equal to the pitch with which teeth 5 follow one another.

The thickness of hooks 8 is such that they fit precisely between teeth 5.

A width B of links 11 is preferably equal to or slightly smaller than a distance D between strip-shaped parts 9 and 10. However, it is not excluded to select width B considerably smaller than distance D.

Fastener 1 will preferably be further provided with an end locking mechanism which is meant to keep the last link in a locked position. This mechanism may be of any nature whatsoever and may for example comprise a slidable element which is slid over the last link or of elastic element which forces the last link in a stretched condition in relation to a second-to-last link.

In FIG. 1, elements 4 and 7 are fixed in the prolongation of parts 2 and 3, which in this case comprise a band, belt or the like, or they are integrally formed with parts 2 and 3. However, it is clear that the fastening may differ depending on the application. If, for example, two layers of a material are to be attached to one another, it is not excluded to attach first element 4 with its bottom side on a top side of the first layer and to attach second element 7 with its top side against a bottom side of the second layer.

To realize a connection with fastener 1, second element 7 is first hooked with a first link behind an optional first tooth. The remaining links 11 are subsequently hooked with hooks 8 behind the following teeth 5 via a roll-down movement. Each consecutive link hereby locks the preceding link. The last link is locked by the above-mentioned locking mechanism which is not represented in the figures. The connection is undone in the opposite sense.

Figure 3:
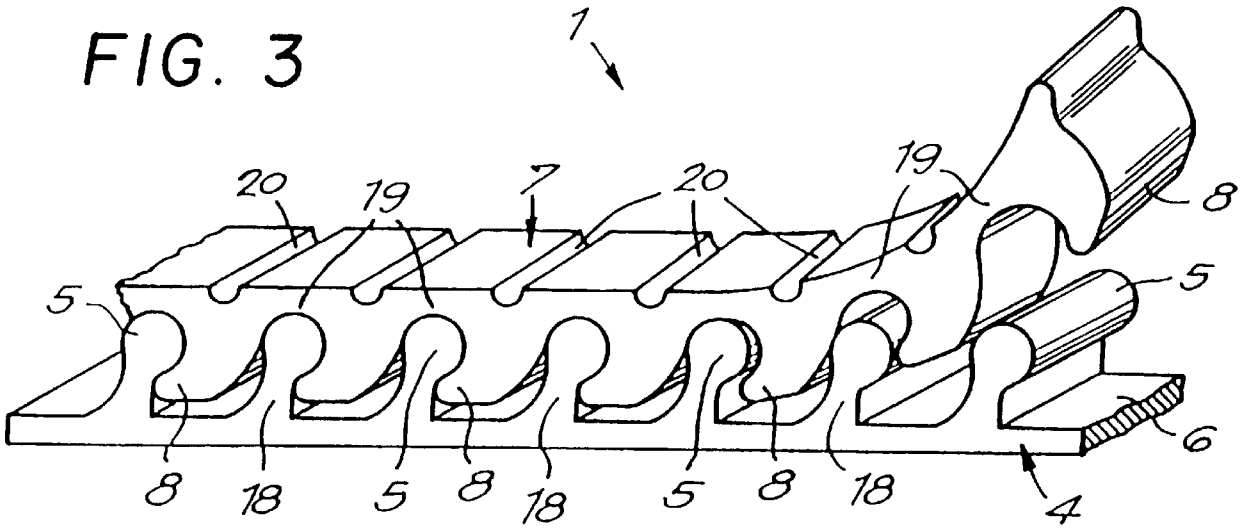
FIG. 3 shows a view in perspective of a second embodiment of the invention.

FIG. 3 shows a variant whereby teeth 5 are fixed to support 6 extending parallel under series of teeth 5 by a series of connecting parts 18. Connecting parts 18 preferably comprise a strip of unbendable material.

Also according to FIG. 3, second element 7 is made as a continuous whole of a flexible material, whereby multiple thin sections 19 function as hinges.

Naturally, fastener 1 of FIG. 3 may be made of any elastic material whatsoever, but it is clear that materials such as rubbers and plastics are particularly suitable.

The working of the fastener according to FIG. 3 is analogous to that of FIG. 1. In the case where a relatively rigid plastic is used, the end locking mechanism may be omitted because an inherent elastic force automatically ensures that second element 7 extends and that hooks 8 remain between teeth 5.

As represented in FIG. 3, second element 7 may be provided with a series of notches 20 on the top side. Notches 20 offer the advantage that the lines of force which are created as a tensile force exerted in the longitudinal direction, are situated lower so that large moments of force are excluded. As a result, the fastener no longer tends to automatically roll down when such tensile forces are exerted.

Notches 20 also offer the advantage that second element 7, when it is made in a die-casting mold, may be easily removed from the mold. Another advantage is that, as far as appearances are concerned, the length of second element 7 is broken.

As represented, notches 20 are provided right between successive sections 19. This offers the advantage that sections 19, which are thin as such, are not weakened. Notches 20 preferably extend over entire width B.

Figure 4:
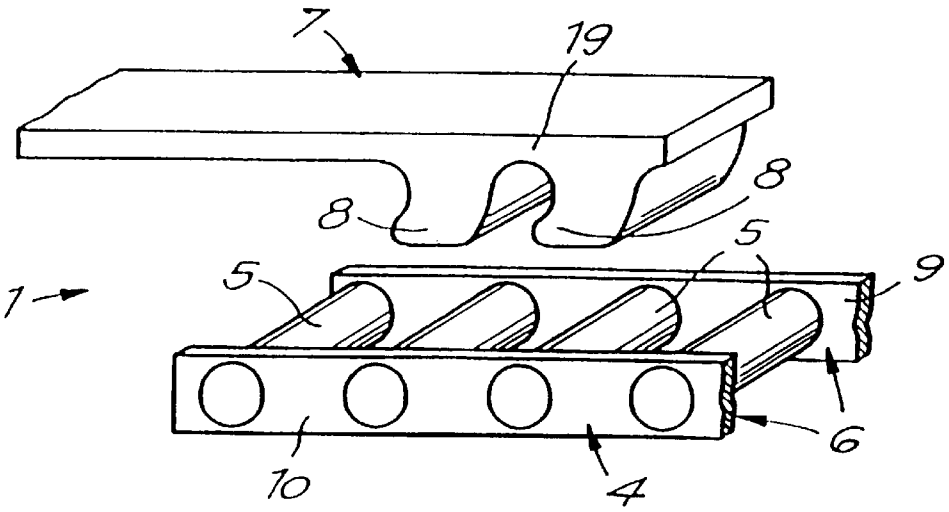
FIG. 4 shows a view in perspective of a third embodiment of the invention.

FIG. 4 shows an embodiment of the invention with a minimum number of hooks 8. Two hooks 8 used hereby form a lock whereby a second hook locks a first hook. First element 4, however, has several teeth 5.

In this way, the fastener according to the invention may be used anywhere as a disengageable connection which may assume variable positions and which may be loaded in any direction by tension, pressure or shear.

It is clear that the invention is by no means limited to the above-described embodiments represented in the accompanying drawings; on the contrary, a fastener according to the invention may be made in various forms and dimensions while still remaining within the scope of the invention.

I claim:

1. A fastener for connecting two parts, comprising:

a first element including at least two transverse teeth consecutively disposed in a longitudinal direction of said first element;

a second element including at least two transverse hooks consecutively disposed in a longitudinal direction of said second element, said transverse hooks being connected to each other and movable in a limited arcuate motion relative to each other in said longitudinal direction of said second element; and wherein said transverse hooks and transverse teeth are formed such that, upon longitudinal alignment of said first and second elements, said limited arcuate motion of said transverse hooks relative to each other freely and consecutively meshes said transverse hooks with said transverse teeth in a first direction to close said fastener without any substantial snap-effect and freely and consecutively unmeshes said transverse hooks from said transverse teeth in an opposite direction to open said fastener without any substantial snap-effect.

2. The fastener according to claim 1, wherein said hooks are made such that said two consecutive hooks enclose one of said teeth therebetween over more than 180° when said fastener is closed.

3. The fastener according to claim 1, wherein said teeth comprise a series of spaced transverse rods.

4. The fastener according to claim 3, wherein said rods extend parallel to one another and have a circular cross-section.

5. The fastener according to claim 1, wherein said first element comprises a support having two strip-shaped parts between which said teeth are situated.

6. The fastener according to claim 5, wherein said support extends from one strip-shaped part to the other on one side of said teeth.

7. The fastener according to claim 1, wherein said second element comprises a series of links linked to one another in said longitudinal direction of said second element, each of said links being provided with one of said hooks.

8. The fastener according to claim 7, wherein said links are linked to one another by pivoting hinges.

9. The fastener according to claim 1, wherein said second element comprises a continuous whole of a flexible material having thin sections which function as hinges.

10. The fastener according to claim 9, further comprising a series of notches provided on a top side of said second element.

11. The fastener according to claim 1, wherein said teeth define a series of openings between said teeth and said hooks fit precisely therein.

12. The fastener according to claim 1, wherein at least said first element is kept in a substantially rigid condition.

13. The fastener according to claim 1, wherein at least said first element is substantially rigid.

14. The fastener according to claim 1, wherein said second element includes a free end, said fastener only being openable by said limited arcuate motion of said transverse hooks relative to each other beginning from said free end of said second element.

* * * * *